US007903053B2

(12) United States Patent
Kawasaki et al.

(10) Patent No.: US 7,903,053 B2
(45) Date of Patent: Mar. 8, 2011

(54) CURRENT PROGRAMMING APPARATUS, MATRIX DISPLAY APPARATUS AND CURRENT PROGRAMMING METHOD

(75) Inventors: Somei Kawasaki, Saitama (JP); Masami Iseki, Yokohama (JP); Fujio Kawano, Kawasaki (JP); Takanori Yamashita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1019 days.

(21) Appl. No.: 11/275,011

(22) Filed: Dec. 1, 2005

(65) Prior Publication Data

US 2006/0132395 A1 Jun. 22, 2006

(30) Foreign Application Priority Data

Dec. 3, 2004 (JP) ..... 2004-351359

(51) Int. Cl.
*G09G 3/30* (2006.01)

(52) U.S. Cl. ..... 345/76; 345/77; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 6,667,580 | B2 * | 12/2003 | Kim et al. | 315/169.3 |
| 6,686,699 | B2 * | 2/2004 | Yumoto | 315/169.3 |
| 6,839,057 | B2 | 1/2005 | Iguchi | 345/204 |
| 6,975,290 | B2 | 12/2005 | Asano | 345/76 |
| 6,989,826 | B2 * | 1/2006 | Kasai | 345/204 |
| 7,071,911 | B2 * | 7/2006 | Inukai | 345/92 |
| 7,106,281 | B2 * | 9/2006 | Kim et al. | 345/76 |
| 7,199,775 | B2 | 4/2007 | Igarashi et al. | 345/87 |
| 7,310,092 | B2 | 12/2007 | Imamura | 345/204 |
| 7,348,947 | B2 * | 3/2008 | Inukai | 345/82 |
| 7,425,937 | B2 * | 9/2008 | Inukai | 345/76 |
| 7,425,939 | B2 | 9/2008 | Asano | 345/76 |
| 7,489,290 | B2 * | 2/2009 | Shin | 345/76 |
| 7,501,999 | B2 * | 3/2009 | Shin | 345/76 |
| 7,742,021 | B2 * | 6/2010 | Shin | 345/76 |
| 2002/0118150 | A1 * | 8/2002 | Kwon | 345/76 |
| 2003/0128200 | A1 * | 7/2003 | Yumoto | 345/211 |

(Continued)

FOREIGN PATENT DOCUMENTS

JP 2003-050564 2/2003

(Continued)

*Primary Examiner* — Alexander Eisen
*Assistant Examiner* — Jason M Mandeville
(74) *Attorney, Agent, or Firm* — Fitzpatrick, Cella, Harper & Scinto

(57) ABSTRACT

A matrix display apparatus includes a plurality of current-driven display devices arranged along row and column directions, a first circuit provided for each of the display devices, a plurality of data lines arranged for each column, with the data lines supplying an image data signal to a plurality of pixel circuits included in each one of the columns, and a plurality of row scanning lines for transmitting a scanning signal for selecting row by row the plurality of pixel circuits. The first circuit includes a field effect transistor for supplying one of the display devices with a current, which has a control electrode and two principal electrodes, a first switch connecting the control electrode and one of the principal electrodes of the field effect transistor, and a second switch having one terminal connected to the one of the principal electrodes of the field effect transistor and having another terminal connected to one of the data lines along the column of the first circuit. The first circuits in the column are connected in successively divided manner to the plurality of the data lines through the second switch.

4 Claims, 5 Drawing Sheets

U.S. PATENT DOCUMENTS

| | | | | |
|---|---|---|---|---|
| 2004/0113873 | A1* | 6/2004 | Shirasaki et al. | 345/76 |
| 2004/0183752 | A1* | 9/2004 | Kawasaki et al. | 345/20 |
| 2004/0207578 | A1* | 10/2004 | Koyama | 345/76 |
| 2005/0007359 | A1 | 1/2005 | Iseki et al. | 345/204 |
| 2005/0104815 | A1* | 5/2005 | Komiya et al. | 345/76 |
| 2005/0122150 | A1 | 6/2005 | Iseki et al. | 327/215 |
| 2005/0174307 | A1* | 8/2005 | Nishitoba et al. | 345/76 |
| 2005/0285151 | A1 | 12/2005 | Kawasaki | 257/213 |
| 2006/0114194 | A1 | 6/2006 | Kawasaki et al. | 345/76 |
| 2006/0114195 | A1 | 6/2006 | Yamashita et al. | 345/76 |
| 2008/0062093 | A1 | 3/2008 | Imamura | 345/77 |

FOREIGN PATENT DOCUMENTS

| | | |
|---|---|---|
| JP | 2003-076327 | 3/2003 |
| JP | 2004-004789 | 1/2004 |
| WO | WO 2004/097787 | 11/2004 |

* cited by examiner

CURRENT PROGRAMMING APPARATUS, MATRIX DISPLAY APPARATUS AND CURRENT PROGRAMMING METHOD

BACKGROUND OF THE INVENTION

1. Field of the Invention

The present invention relates to a current programming apparatus, an active matrix display apparatus and a current programming method therefore, and is particularly advantageously employable in an active matrix display apparatus employing a current-driven display device.

2. Related Background Art

In an active matrix display apparatus employing a field light-emitting device, there is employed, in a drive circuit of each pixel, a current write-in circuit in which a drive current for the light emitting device is written and stored. In the present specification, an operation of writing and storing a drive current in each pixel of such matrix display apparatus is called a current programming, and a circuit for such purpose is called a current programming circuit.

In U.S. Pat. No. 6,686,699, FIG. 18 discloses a current programming circuit which retains a current to be supplied to a data line, as a gate-source voltage of a transistor. This article also describes that, at data writing in the current programming circuit, gradation displays of black and a low luminance level can be improved by flowing such current in a direction of canceling the writing current.

In a prior current write-in pixel circuit, the write-in operation of an image data current may not be executed in a stable manner in each pixel circuit. Such phenomenon will be explained later in more details. One of the causes of the phenomenon attributes to a parasitic capacitance of the data line. When the parasitic capacitance of the data line is large, a fluctuation of the threshold value of drive transistors becomes unnegligible for a small data current.

An object of the present invention is to provide a current programming apparatus, an active matrix display apparatus and a current programming method therefor, allowing to achieve a stable write-in operation of such image data current.

SUMMARY OF THE INVENTION

The object of the present invention is to provide:

A current programming apparatus to which a data current is written as a voltage, comprising:

a plurality of first circuits arranged in a column, each of said first circuits including:

a field effect transistor having a control electrode and two principal electrodes, a first switch connecting the control electrode and one of the principal electrodes of the field effect transistor, and a second switch connecting the one of the principal electrodes and a data line disposed along the column of the first circuit; and a second circuit arranged to the column of the first circuit, wherein the second circuit supplying a data current to the data line for a predetermined period, wherein the first circuits are selected one by one sequentially, the first switch and the second switch of the selected first circuit are turned on during the predetermined period to lead the data current supplied by the second circuit to the control electrode and the one of the principal electrode of the field effect transistor, and thereby a value of the data current is written as a voltage between the control electrode and the other principal electrode of the field effect transistor, and wherein a plurality of data lines are provided for the column of the first circuit, the first circuits in the column are connected in successively divided manner to the plurality of the data lines through the second switch; and the second circuit supplies the data current to the plurality of the data lines successively.

According to an embodiment of the present invention, the current programming apparatus further including a current source which supplies, for a predetermined period within a period of the supply of the data current by the second circuit, a predetermined current to one of the data lines other than the data line to which the data current is supplied, the direction of the predetermined current is the same as the data current to be applied by the second circuit, and a value of the predetermined current is written into a first circuit during a period immediately before the period during which the value of the data current is written into the first circuit.

According to an embodiment of the present invention, the value of the predetermined current is set as a value which, when written in the first circuit, makes the voltage between the control electrode and the other principal electrode of the field effect transistor larger than the threshold voltage of the field effect transistor.

According to an embodiment of the present invention, a period in which the predetermined current is supplied from the current source of the second circuit is shorter than a period in which the data current is supplied from the second circuit.

According to an embodiment of the present invention, the data line is provided in two units, to which odd-numbered and even-numbered first circuits in the column are respectively connected.

According to an embodiment of the present invention, the first circuit further includes a third switch connecting the one of the principal electrode of the field effect transistor and an external circuit; and the third switch is turned on, when the first switch and the second switch are turned off, to lead a current corresponding to the voltage between the control electrode and the one of the principal electrodes of the field effect transistor from the field effect transistor to the external circuit.

A further object of the present invention is to provide a matrix display apparatus comprising:

a plurality of current-driven display devices arranged along row and column directions;

a first circuit provided for each of the display devices and including:

a field effect transistor for supplying the display device with a current, which has a control electrode and two principal electrodes, a first switch connecting the control electrode and one of the principal electrodes of the field effect transistor, a second switch connecting the one of the principal electrodes and a data line disposed along the column direction, and a third switch connecting the one of the principal electrodes of the field effect transistor and the display device; and a second circuit provided for a column of the first circuit and supplying a image data current to the data line for a predetermined period, wherein the first circuits are selected row by row sequentially, the first switch and the second switch of the selected first circuits are turned on during the predetermined period to lead the image data current supplied by the second circuit to the control electrode and the one of the principal electrode of the field effect transistor, thereby a value of the data current is written as a voltage between the control electrode and the other principal electrode of the field effect transistor, and after the predetermined period, the first and second switches are turned off and the third switch turns on to lead a current, corresponding to the written-in voltage from the field effect transistor to the display device to cause a light emission therein; and wherein a plurality of data lines are provided to a column of the first circuit, the first circuits in the column are connected in successively divided manner to the plurality of the data lines through the second switch; and the second circuit supplies the data current to the plurality of the data lines successively.

According to an embodiment of the present invention, the matrix display apparatus further includes a current source provided for a column of the first circuit, the current source supplies, for a predetermined period within a period of the supply of the data current by the second circuit, a predetermined current to one of the data lines other than the data line to which the image data current is supplied, the direction of the predetermined current is the same as the image data current to be supplied by the second circuit, and a value of the predetermined current is written into a first circuit during a period immediately before the period during which the value of the image data current is written into the first circuit.

According to an embodiment of the present invention, the value of the predetermined current is set as a value which, when written in the first circuit, makes the voltage between the control electrode and the other principal electrode of the field effect transistor larger than the threshold voltage of the field effect transistor.

According to an embodiment of the present invention, a scanning line for each row of the first circuit is provided, and wherein scanning lines of consecutive two rows are selected in succession, and the predetermined current is written into a first circuit of a row selected by the preceding scanning line while the image data current is written into a first circuit of a row selected by the succeeding scanning line.

According to an embodiment of the present invention, the data line in a column of the first circuit is provided in two units, to which odd-numbered and even-numbered first circuits in the column are respectively connected.

Further object of the present invention is to provide a current programming method for writing a data current into a plural first circuits arranged in a column, in which each of the first circuits includes:

a field effect transistor having a control electrode and two principal electrodes, a first switch connecting the control electrode and one of the principal electrodes of the field effect transistor, and a second switch connecting the one of the principal electrodes and a data line disposed along the column of the first circuits, the data current is supplied from a second circuit to the data line, the data line is provided in plural units for the column of the first circuit, and the first circuits in the column are connected in successively divided manner to the data lines through the second switch, the method comprising the steps of:

(A) selecting one of the first circuits and turning on the first switch of the selected first circuit for a predetermined period to connect the control electrode and the one of the principal electrodes of the field effect transistor and the second switch of the selected first circuits for a predetermined period to connect the one of the principal electrodes of the field effect transistor and one of the data lines;

(B) leading the data current supplied by the second circuit to the control electrode and the one of the principal electrodes of the field effect transistor through the first and second switches, thereby executing a write-in of the data current as a voltage between the control electrode and the other principal electrode of the field effect transistor of the selected first circuit; and (C) repeating the steps (A) and (B) by selecting the first circuits one by one while the second circuit supplies the data current successively to the data line to which the selected first circuit is connected through the second switch.

According to an embodiment of the present invention, a current source is further included supplying, for a predetermined period within a period of the supply of the data current by the second circuit, a predetermined current to one of the data lines other than the data line to which the data current is supplied, in the same direction as the data current to be supplied;

the programming method further comprising:

(D) turning on the first and second switches of the first circuits which is to be selected in the following predetermined period;

(E) leading the predetermined current to the control electrode and the one of the principal electrodes of the field effect transistor of the first circuit the first and the second switches of which are turned on in the step (D), thereby to write the predetermined current as a voltage between the control electrode and the other principal electrode of the field effect transistor;

wherein a first circuit into which the predetermined current is written by the steps (D) and (E) is selected in an immediately succeeding period of supply of the data current from the second circuit.

According to an embodiment of the present invention, the value of the predetermined current is set as a value which, when written in the first circuit, makes the voltage between the control electrode and the other principal electrode of the field effect transistor larger than the threshold voltage of the field effect transistor.

Further object of the present invention is to provide a driving method of a matrix display apparatus in which a plurality of current-driven display devices are arranged along row and column directions, a first circuit is provided for each of the display devices, which includes:

a field effect transistor for supplying the display device with a current having a control electrode and two principal electrodes, a first switch connecting the control electrode and one of the principal electrodes of the field effect transistor, a second switch connecting the one of the principal electrodes and a data line disposed along the column of the first circuit, and a third switch connecting the one of the principal electrodes of the field effect transistor and the display device;

a second circuit is provided for a column of the first circuit, which supplies an image data current to the data line, and the data line is provided in plural units for the column of the first circuit and the first circuits in the column are connected in successively divided manner to the data lines through the second switch, the driving method comprising the steps of:

(A) selecting one row of the first circuits and turning on the first switch of the selected first circuits for a predetermined period to connect the control electrode and the one of the principal electrodes of the field effect transistor and the second switch of the selected first circuits for a predetermined period to connect the one of the principal electrodes of the field effect transistor and one of the data lines;

(B) leading the image data current supplied by the second circuit to the control electrode and the one of the principal electrodes of the field effect transistor through the first and second switches of the selected first circuit, thereby executing a write-in of the image data current as a voltage between the control electrode and the other principal electrode of the field effect transistor of the selected first circuits;

(C) turning off the first and the second switches and turning on the third switch to connect the one of the principal electrodes and the display device;

(D) leading a current corresponding to the write-in voltage between the control electrode and the other principal electrode of the field effect transistor from the field effect transistor to the display device to cause a light emission therein; and (E) repeating the steps (A)-(D) by selecting the first circuits row by row while the second circuit supplies the image data current successively to the data line to which the selected first circuit is connected through the second switch.

According to an embodiment of the present invention, the second circuit further includes a current source supplying, for a predetermined period within a period of the supply of the data current by the second circuit, a predetermined current to one of the data lines other than the data line in which the data current is supplied, in the same direction as the image data current to be supplied, the driving method further comprising:

(F) a step, within the period of supply of the predetermined current by the current source, of turning on one of the first and second switches of one of the first circuits connected to the data line in which the predetermined current is supplied, and guiding the predetermined current to the control electrode and one of the principal electrodes of the field effect transistor of the first circuit; and (G) a step writing the predetermined current as a voltage between the control electrode and the other principal electrode of the field effect transistor;

wherein a first circuit into which the predetermined current is written by the steps (F) and (G) is selected within an immediately succeeding period of supply of the image data current from the second circuit.

According to an embodiment of the present invention, the value of the predetermined current is set as a value which, when written in the first circuit, makes the voltage between the control electrode and the other principal electrode of the field effect transistor larger than the threshold voltage of the field effect transistor.

Further object of the present invention is to provide a driving device for a matrix display apparatus including plural current-driven display devices arranged in row and column directions, the driving device comprising:

a first circuit provided for each of the display devices and including:

a field effect transistor for supplying the display device with a current having a control electrode and two principal electrodes, a first switch connecting the control electrode and one of the principal electrodes of the field effect transistor, a second switch connecting the one of the principal electrodes and a data line disposed along the column of the first circuit, and a third switch connecting the one of the principal electrodes of the field effect transistor and the display device; and a second circuit provided for a column of the first circuit, which supplies an image data current to the data line, wherein the first circuits are selected row by row sequentially, the first switch and the second switch of the selected first circuits are turned on during the predetermined period to lead the image data current supplied by the second circuit to the control electrode and the one of the principal electrode of the field effect transistor, thereby a value of the data current is written as a voltage between the control electrode and the other principal electrode of the field effect transistor, and after the predetermined period, the first and second switches are turned off and the third switch turns on to lead a current, corresponding to the written-in voltage between the control electrode and the one of the principal electrodes of the field effect transistor, form the field effect transistor to the display device to cause a light emission therein; and wherein a plurality of data lines are provided to a column of the first circuit, the first circuits in the column being connected in successively divided manner to the plurality of the data lines through the second switch; and the second circuit supplies the data current to the plurality of the data lines successively.

According to an embodiment of the present invention, the driving device further includes a current source provided for a column of the first circuit, the current source supplying, for a predetermined period within the period of supply of image the data current by the second circuit, a predetermined current to one of the data lines other than the data line to which the image data current is supplied, in the same direction as the image data current to be supplied, and a value of the predetermined current is written into a first circuit during a period immediately before the period during which the value of the image data current is written into the first circuit.

According to an embodiment of the present invention, the value of the predetermined current is set as a value which, when written in the first circuit, makes the voltage between the control electrode and the other principal electrode of the field effect transistor larger than the threshold voltage of the field effect transistor.

Thus the present invention allows to suppress an influence of a parasitic capacitance of the data line, and to stabilize the write-in operation of the data current.

The present invention is adapted for use in an active matrix display apparatus utilizing a current-driven light emitting device such as a field light-emitting device (EL device) or in an analog memory.

DETAILED DESCRIPTION OF THE PREFERRED EMBODIMENTS

In the following, an embodiment of the present invention will be explained in detail with reference to the accompanying drawings.

Figure 3:
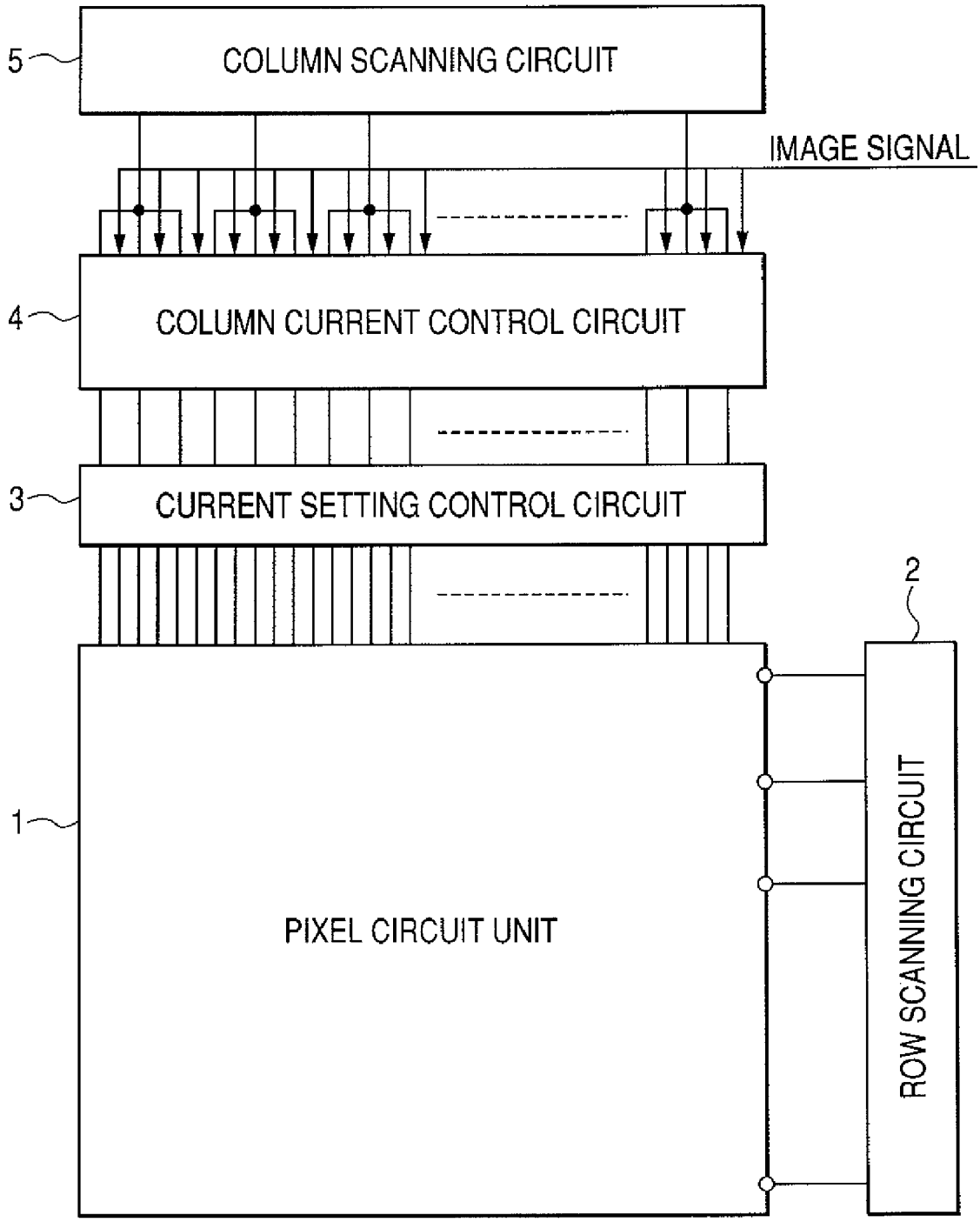
FIG. 3 is a view showing a configuration of an active matrix field light-emission display apparatus of the present invention.

FIG. 3 is a view showing a configuration of an active matrix field light-emission display apparatus of the present invention.

In FIG. 3, there are shown a pixel circuit portion 1 constituted of pixel circuits arrange in a matrix, a row scanning circuit 2 connected to the pixel circuits arranged in a row direction and outputting thereto a row scanning signal P1*m* and a row scanning signal P2*m* (m being a positive natural number equal to or larger than 1) sequentially in succession to the rows, a current setting control circuit 3 provided for each column of the pixel circuits and applying a line-sequential image data current signal $I_{data}$ selectively to two data lines thereby supplying a charging current and defining potential of the two data lines in a vertical blanking period, a column current control circuit 4 for supplying data lines, connected with the pixel circuits arranged in the column direction, with the line-sequential image data current signal $I_{data}$, and a column scanning circuit 5 connected with the column current control circuit 4 for providing the data lines with the the line-sequential image data current signal $I_{data}$.

Figure 1:
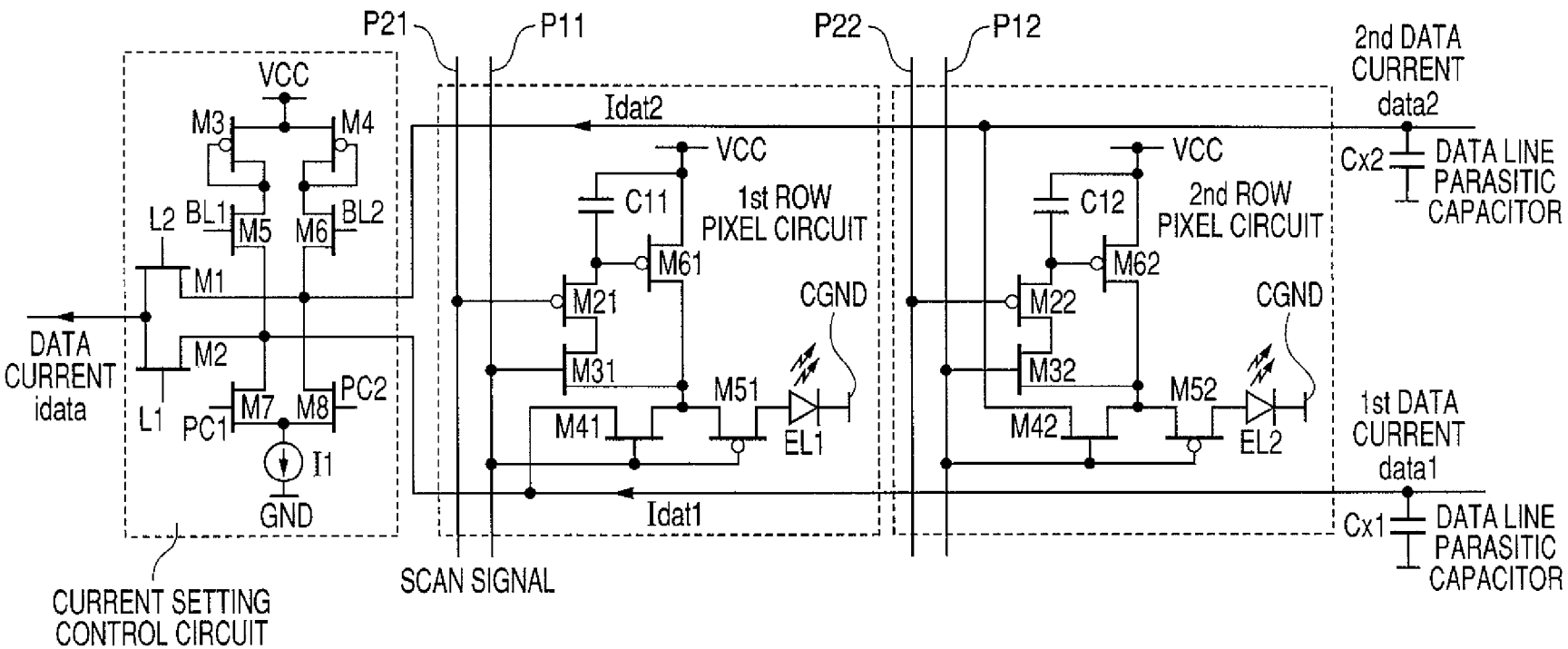
FIG. 1 is a circuit diagram showing a configuration of a pixel circuit and a current setting circuit, constituting a first embodiment of the present invention.
Figure 2:
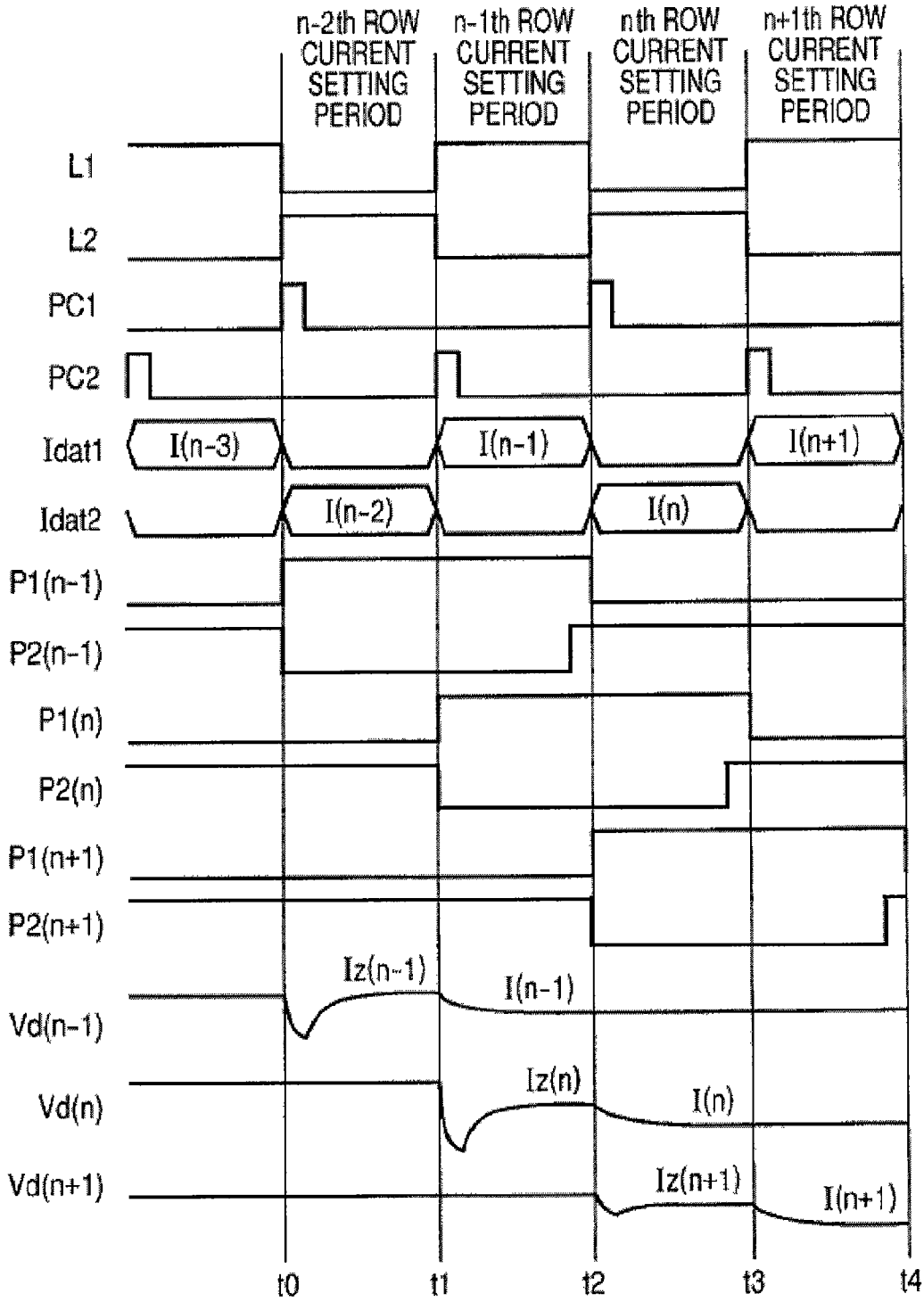
FIG. 2 is a timing chart showing functions of the circuits shown in FIG. 1.
Figure 4:
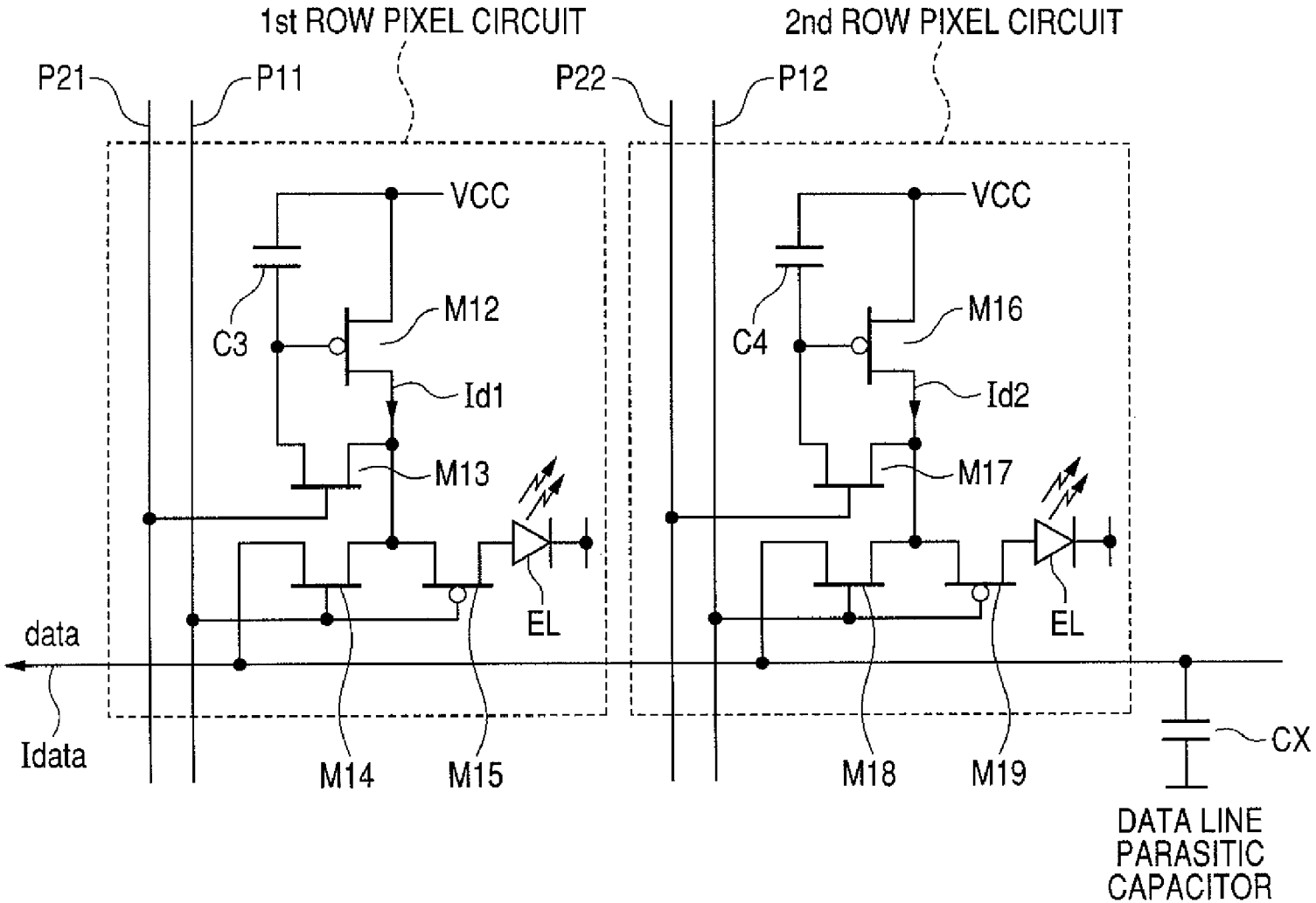
FIG. 4 is a circuit diagram showing a configuration of a pixel circuit in a comparative example.
Figure 5:
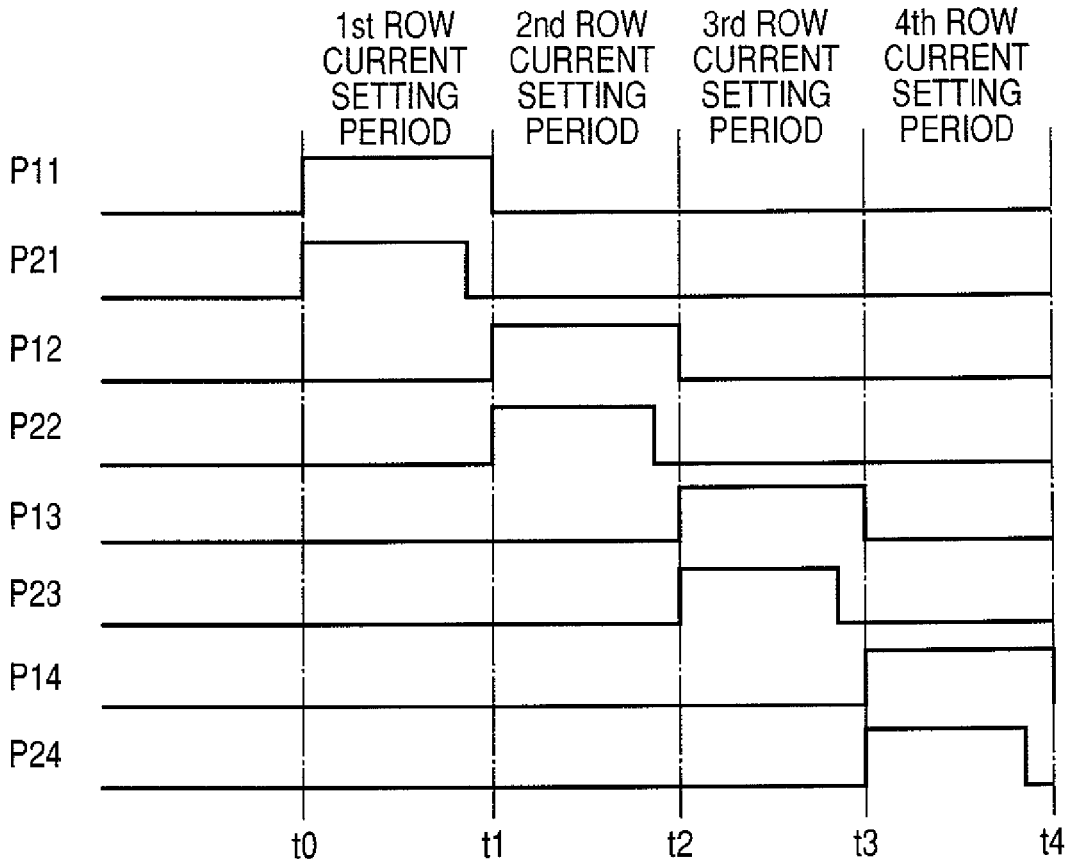
FIG. 5 is a timing chart showing functions of the pixel circuit of the comparative example.
Figure 6:
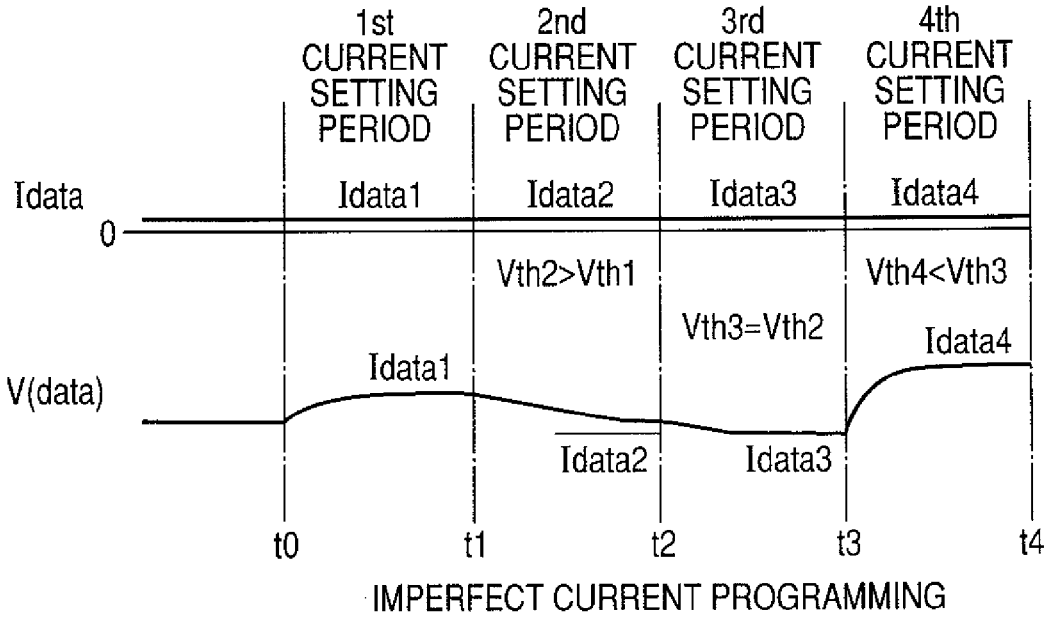
FIG. 6 is a timing chart showing changes in a data current and a data line potential in the pixel circuit of the comparative example.

FIG. 1 is a circuit diagram showing a configuration of a pixel circuit and a current setting circuit, constituting a first embodiment of the present invention. FIG. 2 is a timing chart showing functions of the circuits shown in FIG. 1. FIG. 4 is a circuit diagram showing a configuration of a pixel circuit in a comparative example. FIG. 5 is a timing chart showing functions of the pixel circuit of the comparative example. FIG. 6 is a timing chart showing changes in a data current and a data line potential in the pixel circuit of the comparative example.

At first, for facilitating the understanding of the present invention, a drive current programming operation of a pixel circuit in a comparative example and a light-emitting operation thereafter will be explained with reference to FIG. 4.

Now let us consider the function of a 1st row pixel circuit connected to a certain data line. In FIG. 4, when a row scanning signal P11 is shifted to a high level, an nMOS transistor M14 serving as a first programming (row selecting) switch connected to the data line is turned on, while a pMOS transistor M15 serving as a light emission selecting switch is turned off. Also when a row scanning signal P21 is shifted to a high level, an nMOS transistor M13 serving as a second programming switch is turned on. A voltage of a capacitance C3 connected to the gate of a pMOS transistor M12 serving as a driving switch is set at a gate-source voltage sufficient for causing a current, which drives a field light-emitting device (electroluminescent device) EL based on an image data current in a data line, to pass through the pMOS transistor M12. Then, when the row scanning signal P21 is shifted to a low level, the nMOS transistor M13 serving as the second programming switch is turned off, thereby holding the voltage of the capacitance C3. A period to this point is a first row current setting period (drive current programming period).

Then, when the row scanning signal P11 is shifted to a low level, the nMOS transistor M14 serving as the first programming (row selecting) switch is turned off, while the pMOS transistor M15 serving as the light emission selecting switch is turned on. A gate potential of the drive transistor M12 controls a drive current supply to the field light-emitting device EL, whereby the current therein is controlled. A period of light emission of the field light-emitting device EL (no light emission in case of a black display) is a light emission period. Upon completion of the first row current setting period, a second row current setting period is started, and, a drive current is written based on the image data signal in succession in the current setting period of each row.

A control of each pixel circuit by the current programming described above is effective in that it is basically not influenced by a fluctuation in the characteristics of the drive transistors, but the present invention finds a situation where the programming operation of a small current becomes unstable by a fluctuation in the characteristics of the drive transistors, due to the presence of a parasitic capacitance in the data line, thereby generating a blackish beat in a low luminance area and deteriorating the image quality. This phenomenon, being generated by the fluctuation in the drive transistors, becomes a fixed pattern noise and is noticeable in the observation. This phenomenon becomes more conspicuous in a large-sized panel in which the parasitic capacitance of the data line increases and as the efficiency of the EL device becomes higher.

The above-described phenomenon will be explained with reference to FIGS. 4-6.

Now it is assumed that first to fourth row pixel circuits are connected to a data line, and that the drive current programming is executed in the first to fourth row pixel circuits in first to fourth row current setting periods shown in FIG. 5. It is also assumed that the image data currents are small currents (for displaying a low gradation level or a black) of a same value ($I_{data1}=I_{data2}=I_{data3}=I_{data4}$) pMOS transistors constituting the drive transistors of the first to fourth row pixel circuits respectively have threshold voltages $V_{th1}$, $V_{th2}$, $V_{th3}$, and $V_{th4}$, satisfying relations $V_{th2}>V_{th1}$, $V_{th3}=V_{th2}$, and $V_{th4}<V_{th3}$. In the first row current setting period, when nMOS transistors M14 and M13 are turned on, a gate-source voltage exceeding $V_{th}$ is applied to the gate of the drive transistor M12 of the first row pixel circuit to cause a source-drain current, whereby the gate potential is elevated and converges to a predetermined potential and thus a current based on the image data current $I_{data1}$ is written as a gate-source voltage. In this state, a potential $V_{data}$ of the data line, namely a potential of the parasitic capacitance Cx of the data line assumes a value corresponding to the gate potential of the drive transistor of the first row pixel circuit, and this potential is set close to $V_{th1}$.

Then, in a second current setting period, as the drive transistor M16 of the second row pixel circuit has a threshold voltage $V_{th2}$ of a relation $V_{th2}>V_{th1}$, a source-drain current does not flow in the drive transistor M16 when the nMOS transistors M18, M17 are turned on but a current flows from the parasitic capacitance Cx of the data line whereby the potential $V_{data}$ of the data line declines (a current flow from the date of the drive transistor M16 to the data line and the gate potential declines also), but, because of the parasitic capacitance of the data line, such potential declining is slow and the gate-source voltage of the drive transistor M1 does not exceed $V_{th2}$ within the second row current setting period, so that the current write-in based on the image data current $I_{data2}$ ($=I_{data1}$), namely the current programming, cannot be achieved (current programming failure).

Then, in the third row current setting period, the potential $V_{data}$ of the data line continues to decline (also the gate potential of the drive transistor of a third row pixel circuit (not shown in FIG. 1) continues to decline) and, when the gate-source voltage exceeds $V_{th3}$ ($V_{th3}=V_{th2}$), a source-drain current flows in the drive transistor whereby the gate potential converges to a predetermined potential and a current based on the image data current $I_{data3}$ ($I_{data3}=I_{data2}$) is written as the gate-source voltage.

Then, in a fourth current setting period, as the drive transistor of the fourth row pixel circuit has a threshold voltage $V_{th4}$ of a relation $V_{th4}<V_{th3}$, a source-drain current flows immediately in the drive transistor, whereby the gate potential is elevated and converges to a predetermined potential and a current based on the image data current $I_{data4}$ is written as the gate-source voltage.

The aforementioned current programming failure in the second row current setting period happens because the source-drain voltage of the drive transistor does not exceed the threshold voltage of such drive transistor within the current setting period for the pixel circuit, or, even if such excess occurs, it is too short in time for the current write-in.

In the following, configuration and operations of the pixel circuit and the current setting control circuit of the present embodiment will be explained with reference to FIGS. 1 and 2.

In the present embodiment, field effect transistors M12 and M16 in FIG. 4 correspond to field effect pMOS transistors M61 and M62 in FIG. 1, a control electrode corresponds to a gate thereof, and principal electrodes corresponds to a source and a drain thereof. Also nMOS switches M13 and in FIG. 4 correspond to a pair of pMOS transistor M21 and nMOS transistor M31. Correspondence between other components in FIG. 1 and those in FIG. 4 is that capacitances C11, C12 correspond to the capacitances C3, C4, pMOS transistors M61, M62, M51, M52 correspond to pMOS transistors M12, M16, M15, M19, and nMOS transistors M41, M42 correspond to nMOS transistors M14, M18.

The circuit structure in FIG. 1 is different from that of FIG. 4 in that the switch connecting the drain electrode and the data line in the pixel circuits are formed by a pair of an nMOS transistor M31 and a pMOS transistor 21 in the first row pixel circuit, and by an MOS transistor M32 and a pMOS transistor 22 in the second row pixel circuit.

In case the switches are formed by a single nMOS transistors as shown in FIG. 4, when the gate of the nMOS transistor M13 is shifted from a high level state to a low level state at the end of the drive current programming period, the potential of the capacitance C3 is deviated lower from the potential to be held by the gate-drain parasitic capacitance of the nMOS transistor M13. Thereby a current flowing in the drive transistor M12 unwillingly increases corresponding to the decrease of the gate potential. Deviation of the gate potential to a lower level is fatal especially for display applications of this current programming circuit because a voltage deviation for a small data current seriously disturbs the dark level of a display apparatus.

In the present embodiment a second programming switch connected between the gate and the drain of the drive transistor M11 is formed by a serial connection of a pMOS transistor M21 and an nMOS transistor M31. The above-mentioned problem can be resolved by constituting one of the second programming switches with a series of a pMOS and an nMOS transistors and putting the pMOS transistor nearer to the gate electrode than the nMOS transistor, since the potential of the capacitance C11 is deviated in an opposite direction.

In the present embodiment, plural pixel circuits in a pixel circuit column are alternately connected to first and second data lines. More specifically, pixel circuits in odd-numbered rows are connected to a first data line, and those in even-numbered rows are connected to a second data line. (FIG. 1 illustrates the pixel column of the first row and that of the second row only, for the purpose of simplicity.) Then, as shown in FIG. 2, in an (n−1)th row pixel circuit (n being a positive even natural number) connected to the first data line, a signal L1 is shifted to a high level in an (n−1)th row current setting period to turn on an nMOS transistor M2 thereby guiding an image data current to the first data line, and executing a current write-in based on the image data current. Then, in an n-th row pixel circuit (n being a positive even natural number) connected to the second data line, a signal L2 is shifted to a high level in an n-th row current setting period to turn on an nMOS transistor M1 thereby guiding an image data current to the second data line, and executing a current write-in based on the image data current. In this manner, the image data current is supplied alternately to the first data line and the second data line, and the current write-in is executed based on the image data current in succession on the pixel circuits in a column.

Now explanation will be given on the (n+1)th pixel circuit in an n-th row current setting period and an (n+1)th row current setting period. In the n-th row current setting period, a predetermined current is supplied to the first data line to induce a source-gate current in the drive transistor of the (n+1)th row pixel circuit, and, in the (n+1)th row current setting period, a current write-in, based on the image data signal, is executed in the (n+1)th row pixel circuit.

In the present embodiment, as explained above, the pixel circuit into which the predetermined current is written is a pixel circuit which is selected in an immediately succeeding image data current supply period.

The pixel circuit into which the data current is written and the pixel circuit into which the predetermined current is written are both selected by scanning lines in the row direction. The pixel circuit into which the data current is written is selected by a scanning line, selected in a scanning operation immediately after a scanning operation for selecting the pixel circuit into which the predetermined current is written.

Stated differently, the pixel circuit into which the data current is written and the pixel circuit into which the predetermined current is written are selected by two scanning lines which are positioned in succession in the column direction.

In more details, in the n-th row current setting period, the signal L2 is shifted to a high level to supply the second data line with the image data current thereby executing a current write-in based on the image data current in the n-th row pixel circuit, while the signal L1 is shifted to a low level thereby not supplying the first data line with the image data current, but a signal PC1 is shifted to a high level for a predetermined period to supply the first data line with a predetermined current, whereby the predetermined current in the first data line lowers the gate potential of the drive transistor of the (n+1)th row pixel circuit to induce a source-drain current therein.

As a current write-in based on the image data current is executed by the first data line on the (n−1)th row pixel circuit in the (n−1)th row current setting period, the parasitic capacitance Cx1 of the first data line assumes a potential which corresponds to the gate potential of the drive transistor of the (n−1)th row pixel circuit, and which is close to the threshold voltage $V_{th(n-1)}$ of the drive transistor of the (n−1)th row pixel circuit. In case the threshold voltage $V_{th(n+1)}$ of the drive transistor of an (n+1)th row pixel circuit has a relation $V_{th(n+1)}>V_{th(n-1)}$ and no measures are taken in the n-th row current setting period, an image data current given in the first data line in the (n+1)th row current setting period cannot immediately induce a source-drain current in the drive transistor of the (n+1)th row pixel circuit because of the parasitic capacitance Cx1 of the first data line, whereby the current write-in may become impossible within the (n+1)th row current setting period.

As explained in the foregoing, by supplying the first data line with a predetermined current for a predetermined period in the n-th row current setting period, the potential of the first data line declines (the gate potential of the drive transistor of the (n+1)th row pixel circuit also declines), whereby the source-gate voltage exceeds the threshold voltage $V_{th(n+1)}$ of the drive transistor of the (n+1)th row pixel circuit to induce a source-drain current. Then, when the application of the predetermined current is terminated, the gate potential is elevated to gradually reduce the source-drain current, whereby the source-gate voltage or the potential of the first data line is set at the threshold voltage $V_{th(n+1)}$, and the potential of a first gate line is set close to the threshold voltage $V_{th(n+1)}$.

Then the n-th row pixel circuit shifts to a display period. In the (n+1)th row current setting period, the signal L1 is shifted to a high level to turn on the nMOS transistor M2, thereby supplying the first data line with the image data current and executing a current write-in based on the image data current. In this state, as the potential of the first gate line is set close to the threshold voltage $V_{th(n+1)}$, the image data current supplied to the first data line induces a source-drain current in the drive transistor of the (n+1)th row pixel circuit, thereby executing a current write-in based on the image data current.

Thus, in present embodiment, two data lines are provided for divided supply of the image data current, and a predetermined current is supplied for a predetermined period prior to the current setting period of each pixel circuit, whereby the data line is set at a potential corresponding to the threshold voltage of the drive transistor and exceeds the threshold voltage of the drive transistor based on the image data current upon entering the current setting period, thereby enabling the write-in in securer manner. The present embodiment, utilizing two data lines, can halve the number of pixel circuits connected to each data line and has an effect of reducing the parasitic capacitance. Also three or more data lines may be provided for a pixel circuit column. In such case, in each data line, an interval from an current setting period in which the image data current is applied to a next current setting period is twice of the current setting period, so that a time, from the supply of the predetermined current for a predetermined period to the data line to the setting of the data line to a potential corresponding to the threshold voltage of the drive transistor, can be taken longer and the parasitic capacitance of each data line can be further reduced.

A current setting control circuit shown in FIG. 1 includes a potential setting circuit, a current supply circuit and a selecting switch, and the selecting switch is constituted of a MOS transistor M2 controlled by a signal L1, and a MOS transistor M1 controlled by a signal L2. The signals L1 and L2 alternately assume a high level, thereby supplying the image data current alternately to the first and second data lines.

The current supply circuit is constituted of a MOS transistor M7 controlled by a signal PC1 and connected to the first data line, a MOS transistor M8 controlled by a signal PC2 and connected to the second data line, and a constant current source 11 connected to the MOS transistors M7 and M8. The current supply circuit serves to supply a data line in which the image data current is not supplied, with a predetermined current for a predetermined period (an entire current setting period or a part thereof). The potential setting circuit is constituted of MOS transistors M3 and M4 of which sources are connected to a power source Vcc and in each of which a drain and a gate are connected, a MOS transistor M5 which is provided between the MOS transistor M3 and the second data line and is controlled by a signal BL1, and MOS transistor M6 which is provided between the MOS transistor M4 and the first data line and is controlled by a signal BL2. The potential setting circuit serves to define the potentials of the first and second data lines, by the signals BL1, BL2 set at a high level in a vertical blanking period.

A period of application of the predetermined current is determined in consideration of a switching speed of the switching element and the parasitic capacitance Cx of the data line, in order to lower the potential of the parasitic capacitance Cx of the data line so as to exceed the threshold voltage of the drive transistor. Also the magnitude of the predetermined current is determined in consideration of a fluctuation in the threshold voltage of the drive transistors.

The capacitances C11, C12 may be formed as individual elements, or may utilize gate-source parasitic capacitances (for example an overlapping capacitance between the gate electrode and the source area).

The current programming apparatus of the present invention has been explained, as an example, by an active matrix display apparatus utilizing a current-driven display device, but it is applicable to any application utilizing a current setting circuit in which a current in a data line is held as a gate-source voltage of a transistor, and the application is not limited to an active matrix display apparatus utilizing a current-driven display device such as an LED, a field light-emitting device or an electron-emitting device (electron-emitting device being included in the current-driven display device since a display can be obtained by accelerating electrons emitted from such device for irradiating an image forming member such as a phosphor), but can also be utilized for a current programming of an analog memory or the like. Also the present invention is not limited to a matrix-structured display apparatus but is also applicable to a line-structured display apparatus.

This application claims priority from Japanese Patent Application No. 2004-351359 filed on Dec. 3, 2004, which is hereby incorporated by reference herein.

What is claimed is:

1. An active matrix display apparatus comprising:

a pixel circuit portion wherein a plurality of pixel circuit columns each including a plurality of pixel circuits arranged along one column direction are arranged along a row direction crossing the column direction, and the pixel circuit portion includes a current-driven display device and a drive transistor for controlling a current supplied to the current-driven display device;

first and second separate data lines arranged correspondingly to each of the pixel circuit columns;

a plurality of scanning lines for supplying the pixel circuit portion with scanning signals for selecting the pixel circuits row by row wherein each row of pixel circuits comprises first and second scanning lines arranged correspondingly to each of the pixel circuit rows;

a row scanning circuit for supplying the scanning signals to the plurality of scanning lines; and a current supply circuit arranged correspondingly to each of the pixel circuit columns, wherein the first data lines are connected to the pixel circuits only along odd rows selected by the scanning signals, among the pixel circuits included in the pixel circuit column, the second data lines are connected to the pixel circuits only along even rows selected by the scanning signals, among the pixel circuits included in the pixel circuit column, each current supply circuit, within a row current setting period corresponding to each row, simultaneously supplies one of the first and second data lines with an image data current by utilizing first and second programming signals corresponding to the first and second data lines, and supplies the other of the first and second data lines with a predetermined current by utilizing first and second control signals corresponding to the first and second data lines, when the row scanning circuit supplies the scanning signals to the scanning lines of an (n−1)-th row and an n-th row, with n being an even number, the current supply circuit supplies the first data line with the image data current to execute a programming of the pixel circuits of the (n−1)-th row based on the image data current, and supplies the second data line with the predetermined current to lower gate voltages of the drive transistors of the pixel circuits of the n-th row, and when the row scanning circuit supplies the scanning signals to the scanning lines of the n-th row and an (n+1)-th row, the current supply circuit supplies the first data line with the predetermined current to lower the gate voltages of the drive transistors of the pixel circuits of the (n+1)-th row, and supplies the second data line with the image data current to execute a programming of the pixel circuits of the n-th row based on the image data current.

2. The active matrix display apparatus according to claim 1, wherein the predetermined current is set such that a voltage between a source and a drain of the drive transistor exceeds a threshold voltage level of the drive transistor.

3. A programming method of an active matrix display apparatus comprising:

a pixel circuit portion wherein a plurality of pixel circuit columns each including a plurality of pixel circuits arranged along one column direction are arranged along a row direction crossing the column direction, and the pixel circuit includes a current-driven display device and a drive transistor for controlling a current supplied to the current-driven display device;

first and second separate data lines arranged correspondingly to each of the pixel circuit columns;

a plurality of scanning lines for supplying to the pixel circuit portion with scanning signals for selecting the pixel circuits row by row wherein each row of pixel circuits comprises first and second scanning lines arranged correspondingly to each of the pixel circuit rows;

a row scanning circuit for supplying the scanning signals to the scanning lines; and a current supply circuit arranged correspondingly to each of the plurality of pixel circuit columns, wherein the first data lines are connected to the pixel circuits only along odd rows selected by the scanning signals, among the pixel circuits included in the pixel circuit column, the second data lines are connected to the pixel circuits only along even rows selected by the scanning signals, among the pixel circuits included in the pixel circuit column, each current supply circuit, within a row current setting period corresponding to each row, simultaneously supplies one of the first and second data lines with an image data current and supplies the other of the first and second data lines with a predetermined current, wherein the method comprising steps of:

supplying, by the current supply circuit, the first data line with the image data current to execute a programming of the pixel circuits of an (n−1)-th row based on the image data current, where n is an even number, and supplying, by the current supply circuit, the second data line with the predetermined current to lower the gate voltages of the drive transistors of the pixel circuits of an n-th row, when the row scanning circuit supplies the scanning signals to the scanning lines of the (n−1)-th row and an n-th row; and supplying, by the current supply circuit, the first data line with the predetermined current to lower the gate voltages of the drive transistors of the pixel circuits of an (n+1)-th row, and supplying, by the current supply circuit, the second data line with the image data current to execute a programming of the pixel circuits of the n-th row based on the image data current, when the row scanning circuit supplies the scanning signals to the scanning lines of the n-th row and the (n+1)-th row.

4. The programming method of an active matrix display apparatus according to claim 3, wherein the predetermined current is set such that a voltage between a source and a drain of the drive transistor exceeds a threshold voltage level of the drive transistor.

* * * * *